US005887789A

United States Patent [19]

Szabo

[11] Patent Number: 5,887,789

[45] Date of Patent: Mar. 30, 1999

[54] FOAM REDUCTION SYSTEM

[75] Inventor: Glenn Louis Szabo, Northboro, Mass.

[73] Assignee: The Butcher Company, Marlborough, Mass.

[21] Appl. No.: 873,685

[22] Filed: Jun. 12, 1997

[51] Int. Cl.[6] ..... B05B 1/34

[52] U.S. Cl. ..... 239/1; 239/590; 239/461

[58] Field of Search ..... 239/553, 553.5, 239/590, 590.5, 461, 1, 11; 141/286; 222/547, 548

[56] References Cited

U.S. PATENT DOCUMENTS

| | | | |
|---|---|---|---|
| 477,824 | 6/1892 | Robinson . | |
| 597,842 | 1/1898 | Edmands . | |
| 660,147 | 10/1900 | Crane | 239/461 |
| 2,054,964 | 9/1936 | Barker | 239/461 |
| 2,478,998 | 8/1949 | Boyd et al. | 239/461 |
| 2,562,930 | 8/1951 | Mapes | 439/590 X |
| 2,627,439 | 11/1953 | Wornall . | |
| 3,321,140 | 5/1967 | Parkinson et al. | 239/553.5 X |
| 3,415,294 | 12/1968 | Kelly . | |
| 3,556,410 | 1/1971 | Arant . | |
| 4,413,551 | 11/1983 | Jackson | 239/553 X |
| 4,720,076 | 1/1988 | Hyde . | |
| 5,309,961 | 5/1994 | Franke et al. . | |
| 5,314,121 | 5/1994 | Buss et al. . | |

FOREIGN PATENT DOCUMENTS

| | | | |
|---|---|---|---|
| 14014 | 3/1919 | United Kingdom | 239/461 |

*Primary Examiner*—Kevin Weldon

*Attorney, Agent, or Firm*—Robert L. Goldberg; Peter F. Corless

[57] ABSTRACT

A foam break device and a system for use of said device. The system comprises an outlet tube for a filling machine using an air gap proportioner. The device has a plurality of vanes and beveled edges for positioning in the bottom of the outlet tube of the filling machine. The device reduces the amount of foam discharged from the system.

12 Claims, 2 Drawing Sheets

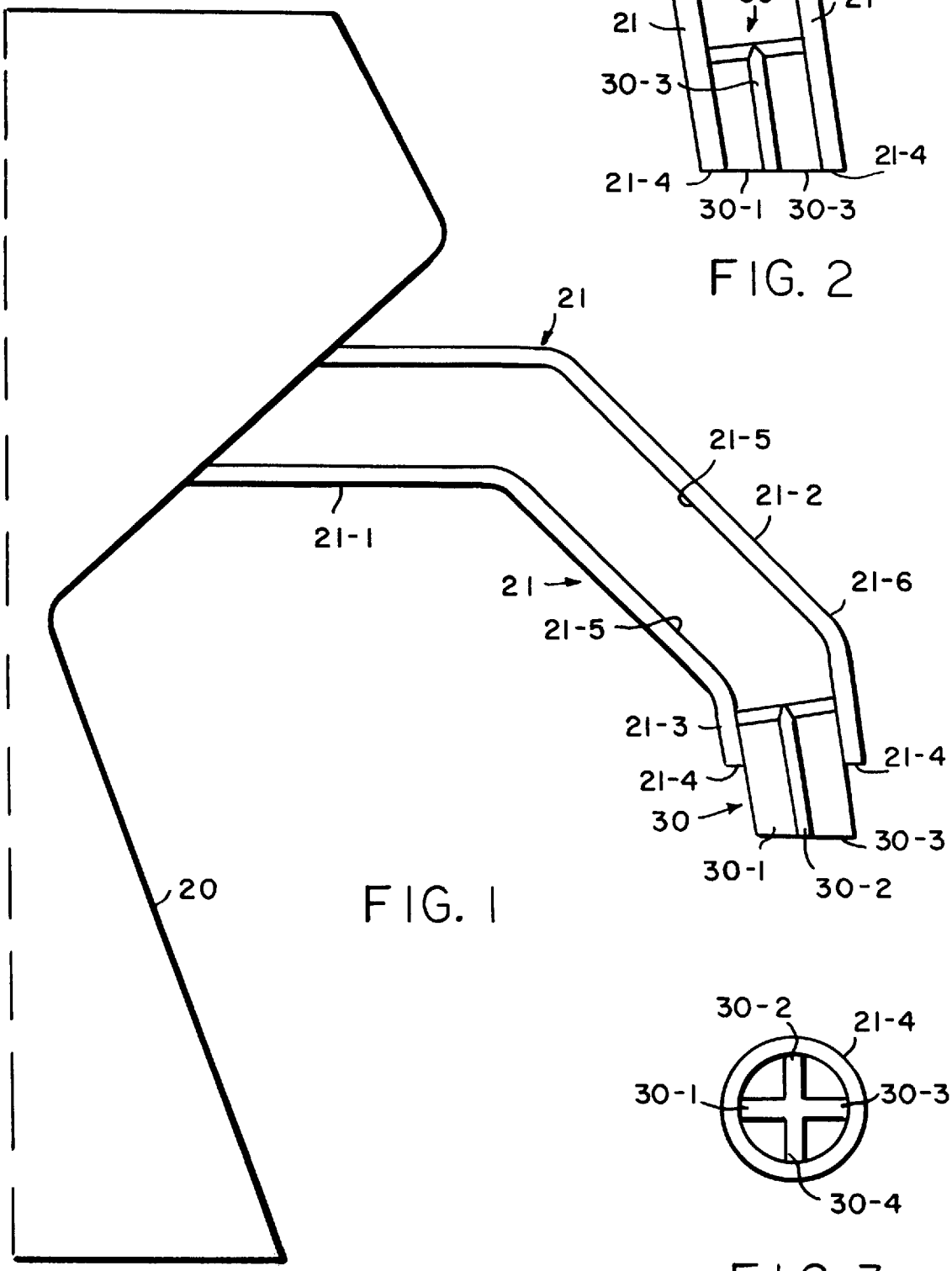
FIG. 1
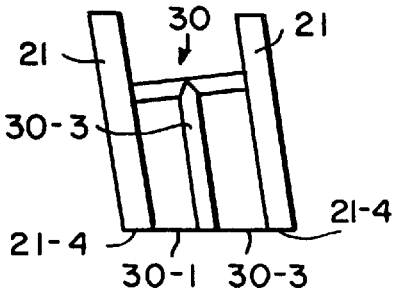
FIG. 2
FIG. 3

FOAM REDUCTION SYSTEM

BACKGROUND OF THE INVENTION

This invention is directed to systems for reducing foam in spray bottles filled from systems using air gap proportioners (eductors). In cleaning applications, e.g. in office buildings, hospitals and etc., it is common for the cleaning personnel to fill the spray containers they carry around when they clean with various cleaning fluid. In one system now on the market known as the Butchers Command Center sold by The Butcher Company, Inc. of Marlborough, Mass., cleaning products such as spray and wipe cleaners, floor cleaners, strippers, degreasers and deodorants from large containers are first diluted and then are used to fill the typical spray containers using air gap proportioner systems to effect filling of the containers from a curved outlet tube.

It has been found that with such a filling system, too much foam has filled the spray container thereby limiting the amount of cleaning fluid actually being dispensed into the spray container. It has been found that the amount of foam in the spray container after filling has been in the order of 50 percent.

Accordingly, it was determined that a method and device had to be devised which would reduce the amount of foam in the container and thereby increase the amount of cleaner received by the spray container.

With the present invention, it has unexpectedly been found that the amount of foam in the spray container has been decreased to about 15 percent after filling. This has also been accomplished without having to make modifications of the filling system and thus has saved considerable money.

Background information relating to foam control may be had by reference to the following U.S. Pat. Nos. 5,314,121; 4,574,853; 3,321,140; 477,824; 2,627,439; 4,512,379; 5,309,961; 3,415,294; 597,842; 3,556,410; 4,720,076; 5,573,145; 4,030,897; 3,960,525; 4,333,747; 4,208,193; 4,058,481; 4,456,033; 4,493,443; 4,720,076; 5,573,145; 5,603,363; 5,316,779; 5,141,035; and 5,050,806.

SUMMARY OF THE INVENTION

BRIEF DESCRIPTION OF THE DRAWINGS

FIG. 1 diagramatically illustrates the use of the foam reduction system of this invention which includes a foam break device in a discharge tube of a bottle filling machine;

FIG. 2 shows in a side view the foam break device fitted into the end of the discharge tube of the filling machine;

FIG. 3 shows in a bottom view the foam break device in the discharge tube of the filling machine;

DETAILED DESCRIPTION OF THE INVENTION

Reference should now be had to FIGS. 1 to 8 for a description of the invention.

In particular FIG. 1 shows the foam break device 30 being inserted into the end of a discharge tube 21 of a filling machine 20. The filling machine is of the type sold by The Butcher Company of Marlborough, Mass. to the cleaning industry under the brand designation BUTCHERS COMMAND CENTER. The Command Center filling machine normally provides concentrate of e.g. cleaners, disinfectants and etc. which is diluted with water to a small liquid spray container. In using the filling machine, the user places the spray container with the spray cap off under the discharge tube outlet end to receive the diluted concentrate. The discharge tube has three distinct sections 21-1, 21-2 and 21-3 with curved portions between sections.

The foam break device 30 is shown being forced into and wedged against the inner wall of the flexible outlet tube section 21-3 (See FIG. 1). The outlet section has a bottom outer surface 21-4 between the inner and outer wall of the tube 21. The solid line in the interior of the tube represents the inner wall 21-5 of the tube and the outer walls shown at 21-6. Because the foam break device is wedged in the round plastic tube 21, it distorts it so that it appears non-circular in shape as seen in FIG. 3 when the break device is pushed upwardly as seen in FIG. 1 to a point where it is almost flush with the bottom surface 21-4 as seen in FIG. 3.

Figure 4:
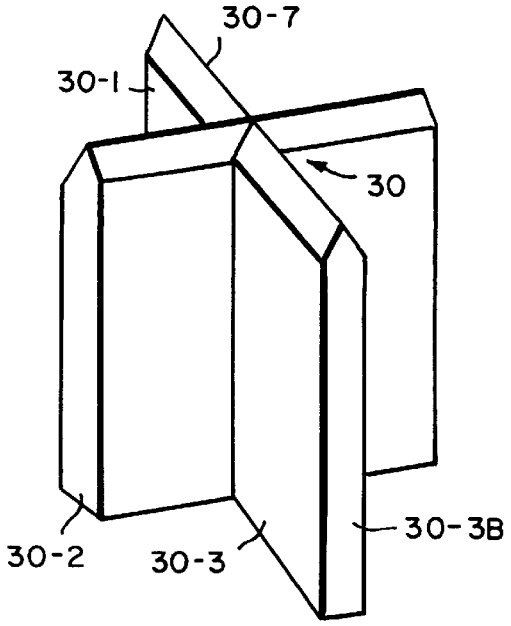
FIG. 4 is a perspective view of the foam break device of this invention.
Figure 6:
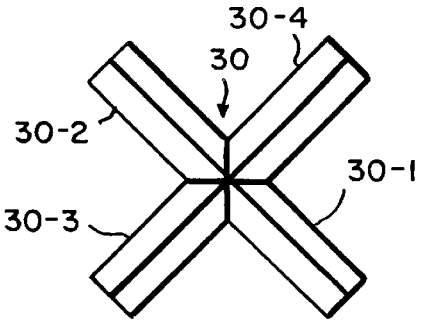
FIG. 6 is a top view of the foam break device of the invention.
Figure 7:
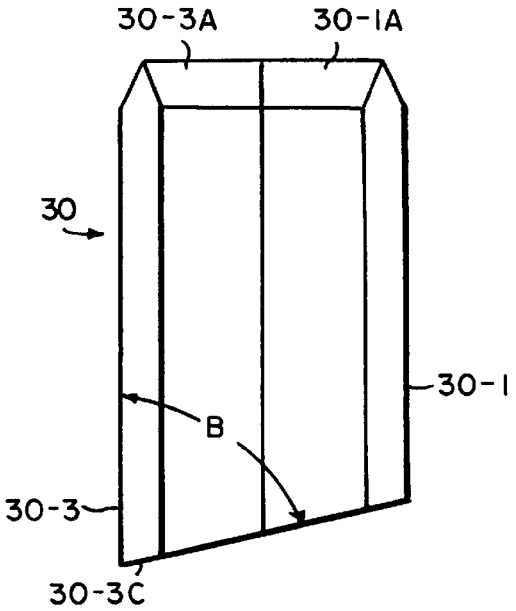
FIG. 7 is a side view of FIG. 6.

The foamy liquid from the outlet tube is directed against the foam break device 30 beveled surfaces (See FIGS. 2, 4, 6 and 7) and hence between the vanes 30-1, 30-2, 30-3 and 30-4 and the inner wall 21-5 of the tube 21 so that the foam is substantially reduced as it comes out of the end of the tube section 21-3 for filling a spray container (not shown). As may be seen in FIGS. 1 and 2, the longest vane 30-3 preferably faces frontwardly and away from the filling machine 20 whereas the shortest vane is preferably positioned opposite the longest vane 30-3. FIGS. 4, 5, 6 and 7 illustrate the beveled edges 30-1A, 30-2A, 30-3A and 30-4A. It has been found that the angle A between the edges, e.g. 30-2A (See FIG. 5) forming the bevels is preferably about 60° although this may vary somewhat e.g., from 50° to 70°. As shown in FIG. 7, the angle B between the bottom of the vanes 30-1 to 30-3 is preferably about 80° so that it will fit substantially flush with the bottom 21-4 of the tube 21 and match the angle of the discharge tube at section 21-3 although this may vary if the tube configuration changes. The number of vanes used in this invention has been found to be best if there are four in number, however, this is not to preclude the use of 3 to 8 vanes. The vanes are most preferably intersecting at substantially right angles to one another where they meet as shown in the drawings, however the angle at crossover may vary somewhat and will change if more vanes are used although four vanes at substantially right angles to to one another is most satisfactory.

Figure 5:
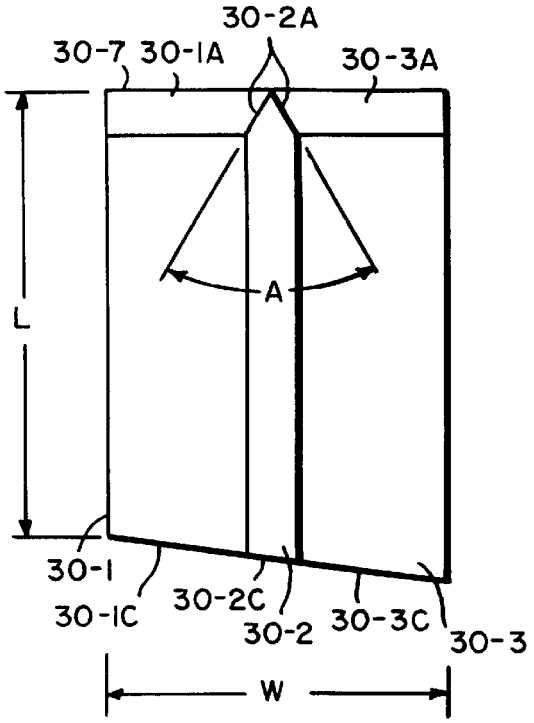
FIG. 5 is an enlarged side view of the foam break device of this invention.
Figure 8:
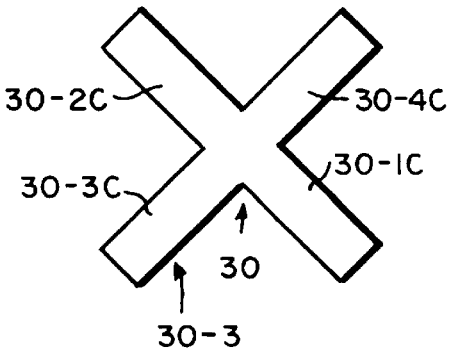
FIG. 8 is a bottom view of the foam break device of the FIGS. 1 to 7.

It has also been found advantageous in practicing the invention that the length (1) of the longest vane bottom 30-3*c* to the top of the foam break device 30-7 be about 1.4 to 1.6 times the width (w) of the foam break device (See FIG. 5).

Tubing 21 in this type of system is generally ⅜" in inside diameter and is usually 6 to 12" long. A foam break device as shown herein having a vane thickness of about 0.064", a longest vane length of about 0.598", shortest vane length of 0.530" and a width of about 0.406" has been found able to reduce foaming from about 50 percent to about 15 percent based on use.

It should be understood that the above measurements are only given by way of example and are not to be considered as limiting the scope of the invention.

It should also be understood that while the preferred embodiment as disclosed herein shows the foam break device wedged into a flexible tube as the best way of using the foam break device 30, strapping on a band around the outside of the tube may be used to retain the device 30 in the tube. Other means such as nibs (pins) on the foam break device 30 sides that fit into a channel formed in the tube 21 inside side wall and closed at the end closest to the tube 21 outlet to retain the foam break device in place inside the tube) even if the tube 21 is somewhat rigid or even rigid are acceptable. Accordingly, the invention is not to be considered as limited in its broadest aspect.

Accordingly, this invention provides a new and improved system and method for decreasing foam when the foam break device 30 of this invention is placed as described herein, with the bevels positioned upstream of the outlet of the tube 20, and the foamy liquid is forced against the bevels of the device 30.

I claim:

1. A system comprising a curved flexible tube adapted to discharge foamy liquids at an outlet end thereof, and a device placed inside the outlet end of the tube and held therein, said device deforming the outlet end of the tube and wedged therein, said device comprising four vanes intersecting at substantially right angles and of substantially equal width and having beveled edges upstream from the outlet end of the tube, the length of the vanes being greater than the overall width of the vanes whereby the amount of foam discharged from the system is substantially reduced as a consequence of said device placed inside of the outlet end of the tube.

2. The system of claim 1 wherein one of the vanes is of a length which is greater than the length of the other three vanes.

3. The system of claim 1 in which angle A between beveled edges is 50° to 70°.

4. A device for placement in the open end of a tube for reducing the amount of discharge foam being expelled from a tube comprising intersecting vanes of substantially equal width and having beveled edges at one end of each of the vanes, the length of the vanes being greater than the overall width of the vanes, the length of one of said vanes being greater than the length of the remaining vanes, and the vanes being 3 to 8 in number.

5. The device of claim 4 in which the vanes are four in number and they intersect at substantially right angles.

6. The device of claim 4 in which angle A between beveled edges is 50° to 70°.

7. A method of reducing the amount of foam being discharged with a liquid from a tube outlet comprising the step of discharging a foamy liquid in a tube over beveled edges of crossed vanes and then between the vanes and the interior of the tube, said vanes positioned in the tube interior upstream from the tube outlet and the length of one of said vanes being greater than the length of the remaining vanes.

8. The method of claim 6 in which the vanes are four in number.

9. A system comprising a tube adapted to discharge foamy liquids at an outlet end thereof, and a device placed inside the outlet end of the tube and held therein, said device comprising intersecting vanes of substantially equal width vanes and having beveled edges upstream from the outlet end of the tube, the length of the vanes being greater than the overall width of the vanes and the length of one of said vanes being greater than the length of the remaining vanes, whereby the amount of foam discharged is substantially reduced as a consequence of said device placed inside of the outlet end of the tube.

10. The system of claim 9 in which the vanes are four in number.

11. The system of claim 9 in which the angle A between beveled edges is 50° to 70°.

12. The system of claim 9 wherein said device is a retained in said tube.

* * * * *